US005348290A

United States Patent [19]

Matherne et al.

[11] Patent Number: 5,348,290

[45] Date of Patent: Sep. 20, 1994

[54] BALL RETURN APPARATUS AND METHOD

[76] Inventors: Lonny R. Matherne, #10 Chimes Cir., Ogden, Utah 84405; Barry D. Mower, 3310 E. Twin Peaks Dr., Layton, Utah 84040

[21] Appl. No.: 100,568

[22] Filed: Jul. 30, 1993

[51] Int. Cl.[5] ..... A63B 69/00

[52] U.S. Cl. ..... 273/1.5 A

[58] Field of Search ..... 273/1.5 R, 1.5 A, 394, 273/396; 193/25 A, 25 R, 255 C

[56] References Cited

U.S. PATENT DOCUMENTS

| | | | |
|---|---|---|---|
| 3,233,896 | 2/1966 | King | 273/1.5 A |
| 3,814,421 | 6/1974 | Spier, Jr. | 273/1.5 A |
| 3,945,638 | 3/1976 | Luebkeman | 273/1.5 A |
| 4,720,101 | 1/1988 | Farkas, Jr. | 273/1.5 A |
| 4,957,289 | 9/1990 | Kotzarz | 273/1.5 A |

*Primary Examiner*—Paul E. Shapiro
*Attorney, Agent, or Firm*—Madson & Metcalf

[57] ABSTRACT

A basketball return apparatus is disclosed, together with a method for switching the apparatus between an active mode and a passive mode. The apparatus comprises a plurality of supports secured to a runway, and may also include one or more struts connected to the runway and connectable to the supports. In the active mode, the supports hang from the basketball hoop by hooks or other releasable attachment means, so the additional poles and extensive webbing of conventional systems are not needed. The supports and the runway form a channel leading downward and away from the hoop. The channel is preferably arcuate. After each successful shot, the apparatus returns the ball to the player's vicinity. The channel may be oriented at various angles relative to the backboard to control the direction in which balls are returned. In the passive mode, the ball return apparatus is detached from the basketball hoop and is disposed substantially flat for storage or shipping. The apparatus is light in weight, and is preferably formed of a single continuous piece of polypropylene. A single player may switch the apparatus between its active and passive modes quickly and without the assistance of hand or power tools.

11 Claims, 2 Drawing Sheets

BALL RETURN APPARATUS AND METHOD

FIELD OF THE INVENTION

The present invention relates to a ball return device having an active use mode and a passive compact storage mode, and more particularly to a portable basketball return device which may be attached to a basketball hoop for use or detached from the hoop and flattened for storage or shipping.

TECHNICAL BACKGROUND OF THE INVENTION

Because of the popularity of basketball, particularly in the United States, many people play the sport and devote considerable time to the development of their basketball skills. Millions of basketball goals have been mounted on barns, telephone poles, garages, and the like so basketball enthusiasts can conveniently enjoy a game of basketball or the solitude of shooting a few baskets.

In developing their shooting skills, however, players are faced with the continual inconvenience of retrieving the basketball after each shot before another shot can be attempted. Occasionally a basketball will bounce off the basketball hoop or backboard in the general direction of the player, thereby reducing the inconvenience. Successful shots, however, almost never return to the shooter after passing through the basketball hoop.

Several approaches have been devised for dealing with the inconvenience of retrieving the basketball. Some conventional systems place a fence, web, or similar barrier around and under the basketball backboard. Such systems commonly include a channel extending from the basketball goal at a given angular orientation relative to the backboard and for a given radial distance from the backboard. The channel includes two vertical sides and an inclined floor attached to the bottom of each side. The sides and floor are formed with webs or rigid sheets. Missed shots rebound off the web sides onto the floor, while successful shots drop through the hoop onto the floor. The basketball then rolls down the inclined floor to the waiting player. These systems thus return not only successful shots but also many unsuccessful shots as well.

Retrieval systems thus utilizing webs have several disadvantages. Such systems are generally permanent in nature, or at the least require substantial amounts of time to assemble and disassemble. To maximize the shots retrieved, the amount of webbing is generally substantial. The web is supported by a framework of poles and braces, which must be erected on the basketball court. Because of the system's bulk and the substantial disassembly time required, such systems are not convenient to store. Some systems using webs collapse somewhat for storage, but nonetheless occupy a substantial volume. Additionally, such systems are relatively expensive, because of their complexity and the amount of materials involved.

Some systems using webs to retrieve basketballs also limit the positions from which shots may be attempted. The sides of the channel may substantially interfere with shots from the side of the basketball court. In such cases, the player is effectively restricted to shooting along the channel, that is, at the same angle to the backboard as the channel. Moreover, the radial length of the channel may be fixed, so that shots cannot be attempted closer to the basketball goal without climbing into the channel and thereby damaging the retrieval system. Shots may be attempted at a greater radial distance from the goal, but the player must generally return to the end of the channel to retrieve the ball.

A further disadvantage of systems using extensive webs is that they obstruct running play by appropriating large sections of the basketball court for their own use. Indeed, many of the systems require the erection of posts, poles, braces, or similar supportive structures in the middle of the basketball court, and involve hanging webs between such posts and the backboard or other posts. Installing such a retrieval system may effectively prevent a basketball court from being used for typical basketball games, which involve substantial movement around the court in addition to shooting.

Other approaches to ball retrieval also have known disadvantages. If two players are available, one player may be assigned the duty of standing near the basketball hoop, capturing the ball after each shot, and returning it to the other player. This role of retriever is generally much less sought after than is the role of shooter, at least among more avid players, because it is much less relevant to competitive basketball play.

If a player is shooting baskets alone, the shooter must also act as the retriever. In this case the inconvenience of retrieving balls may interfere significantly with skill development by preventing the player from taking shots in reasonably rapid succession. Before each shot, the developing player ideally makes small adjustments in shot parameters such as aim and force as compared to the parameters used during the previous shot. Shooting skills improve as the player gauges and reacts to the effect of these adjustments, the effects being indicated by the shot. Retrieving the ball breaks the continuity of this learning process, making it difficult for the player to concentrate, and to adjust shot parameters appropriately.

Moreover, many avid basketball players have only limited time to spend developing their shooting skills. For instance, a player may have one-half hour to spend on the court on a given day. Ball retrieval consumes precious minutes of the limited available time, thereby reducing the number of shots that can be taken in the given half-hour.

Some players therefore utilize multiple basketballs, especially when there is no other player present and willing to act as a ball retriever. Thus, a player might shoot several basketballs, then retrieve them all, and then shoot them all again. One disadvantage of this approach is the cost of the additional basketballs. Another disadvantage is the size of the balls. Unlike golf balls, for instance, a container of ten or twenty basketballs is not conveniently carried by a player. Moreover, the balls must still be retrieved. Even if the player suffers only a minimal delay between most of the shots, substantial time is eventually still spent pursuing balls rather than practicing shots.

Thus, it would be an advancement in the art to provide a ball return apparatus and method that does not require one player to forego shooting by playing the role of ball retriever.

It would be a related advancement to provide such a ball return apparatus and method that does not substantially interfere with normal running play by blocking large sections of the basketball court with a web or similar device.

It would also be an advancement in the art to provide a ball return apparatus and method that one player may easily and quickly assemble and disassemble.

It would be a related advancement to provide such an apparatus and method that is relatively small when disassembled and therefore easy to store or ship.

It would be a further advancement to provide such an apparatus that encourages successful shots by returning the ball to the player after those shots.

Such an apparatus and method for returning balls is disclosed and claimed herein.

BRIEF SUMMARY OF THE INVENTION

The present invention relates to an apparatus and method for a basketball return having an active mode and a passive mode. In the active mode, the apparatus is attachable to a basketball hoop for returning a basketball to a player after each successful shot. In the passive mode, the apparatus is detached from the hoop and is substantially flat for easy shipping or storage.

In a presently preferred embodiment, the apparatus of the present invention includes a runway secured to four supports. Two supports are positioned on each side of the runway. The apparatus also includes two struts that are connected to the runway and connectable to the supports. In the active mode, the supports, struts, and runway together form a channel which directs a basketball in a desired direction after it passes through the hoop.

The active runway is suspended beneath the hoop by the supports, well above and out of contact with the basketball court floor. Each support has one end secured to the runway and another end having a hook. Each hook hangs over the basketball hoop. The hooks are preferably formed of polypropylene plastic or a similar material having a "memory." They are C-shaped so as to snap on and remain on the hoop until opened by the player.

One strut is disposed on each side of the runway for adding structural stability when the apparatus is active. Each strut has a secured end, which is integral with the runway, and an anchorable end. Each strut also has an opening through which a support may pass.

In operation, the apparatus may be taken from the passive mode to the active mode, or vice versa. To configure the presently preferred embodiment of the apparatus into its active mode from its passive mode, one support on a given side is passed through the opening in the strut on that side. Then the anchorable end of the strut is anchored to the second support on that side of the runway. This procedure is repeated with the strut and supports on the other side of the runway. Anchoring the struts flexes the previously substantially flat runway into an arc. The flexed runway, the supports, and the struts together form the ball return channel.

Next, the hooks on the supports are hooked about the basketball hoop so that the supports hold the apparatus above the basketball court floor, with the upper end of the channel directly beneath the hoop. Alternatively, the hooks may be placed before the runway is flexed. In either case, the hooks are placed on the hoop in positions that point the lower end of the channel in a desired direction, so that the apparatus returns the ball in that direction after each successful shot.

To reach the passive mode from the active mode, the procedure just outlined is reversed. The apparatus is detached from the basketball hoop by opening the hooks far enough to disengage them. The hooks are opened by application of manual pressure to one end of the C-shape which forms each hook. The anchorable ends of the struts are freed from two of the supports, and the other two supports are unthreaded from the openings in the struts. Finally, the entire apparatus is laid out on a shelf, slid into a substantially flat box, or otherwise stored. Assembling the apparatus for use and disassembling it for storage thus requires little time and no hand or power tools.

Once the apparatus is in active mode on the basketball hoop, basketballs which pass through the hoop will encounter the runway, roll down the channel in a generally desirable direction, and return to the shooter's region. Because the apparatus is supported by the basketball hoop above the floor or other playing surface, and is relatively small, it does not interfere with play by blocking a large portion of the basketball court.

In addition, players who wish to avoid running after balls are provided an incentive to improve their shooting. The apparatus does not surround the backboard, so it does not return the ball after unsuccessful shots. After successful shots, however, the ball is returned.

These and other features and advantages of the present invention will become more fully apparent through the following description and appended claims taken in conjunction with the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide data concerning a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference is now made to the figures wherein like parts are referred to by like numerals. One preferred apparatus embodying the present invention is generally designated 10 in FIG. 1. The apparatus 10 has an active mode, depicted in FIG. 1, and a passive mode, depicted in FIG. 2. Although FIG. 1 best illustrates the apparatus 10 as it is principally used, many structural features of the apparatus 10 are best illustrated in FIG. 2.

Figure 1:
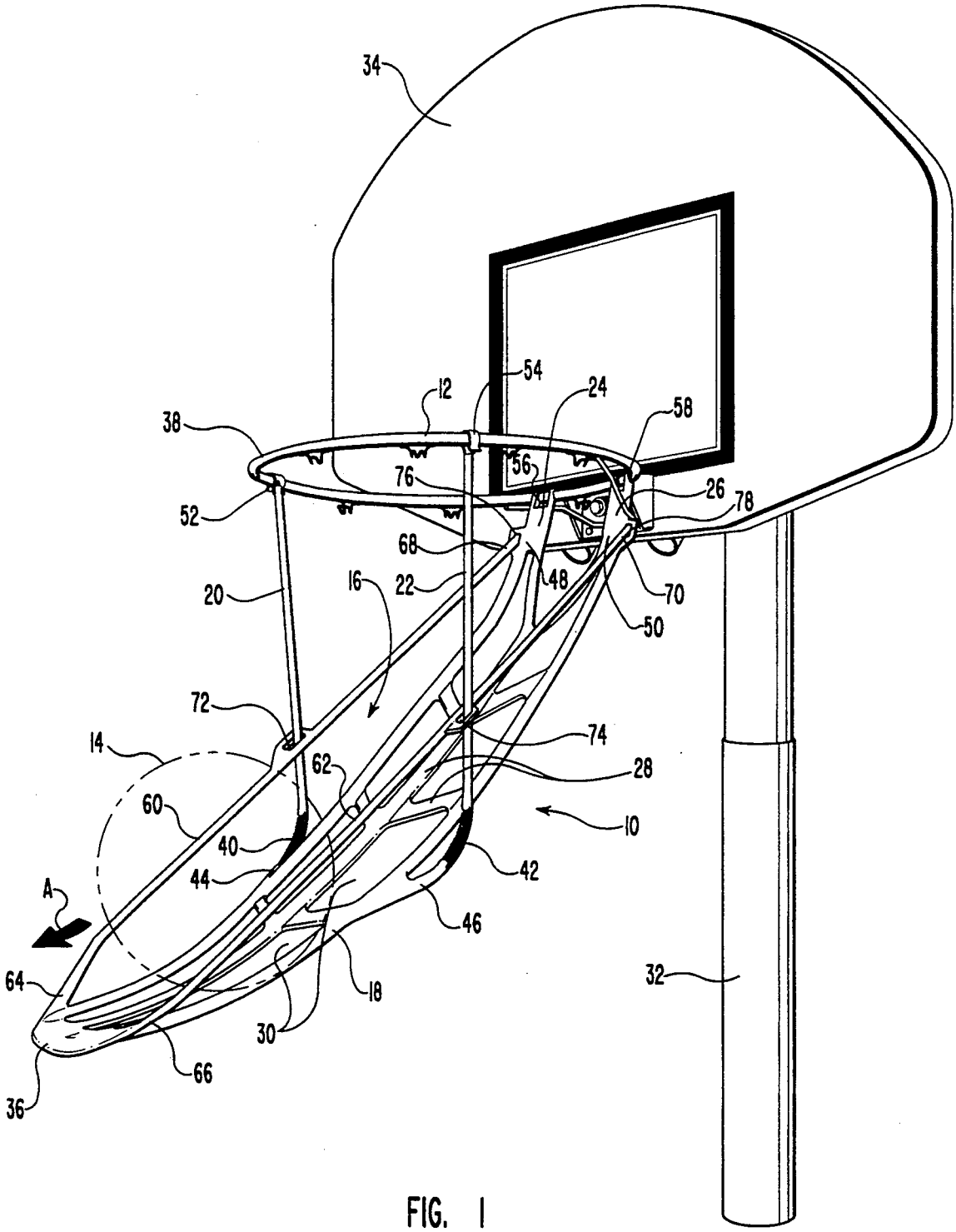
FIG. 1 is a perspective view of a presently preferred embodiment of the ball return apparatus in active mode attached to a basketball hoop. The basketball net has been removed to more clearly illustrate the apparatus.
Figure 2:
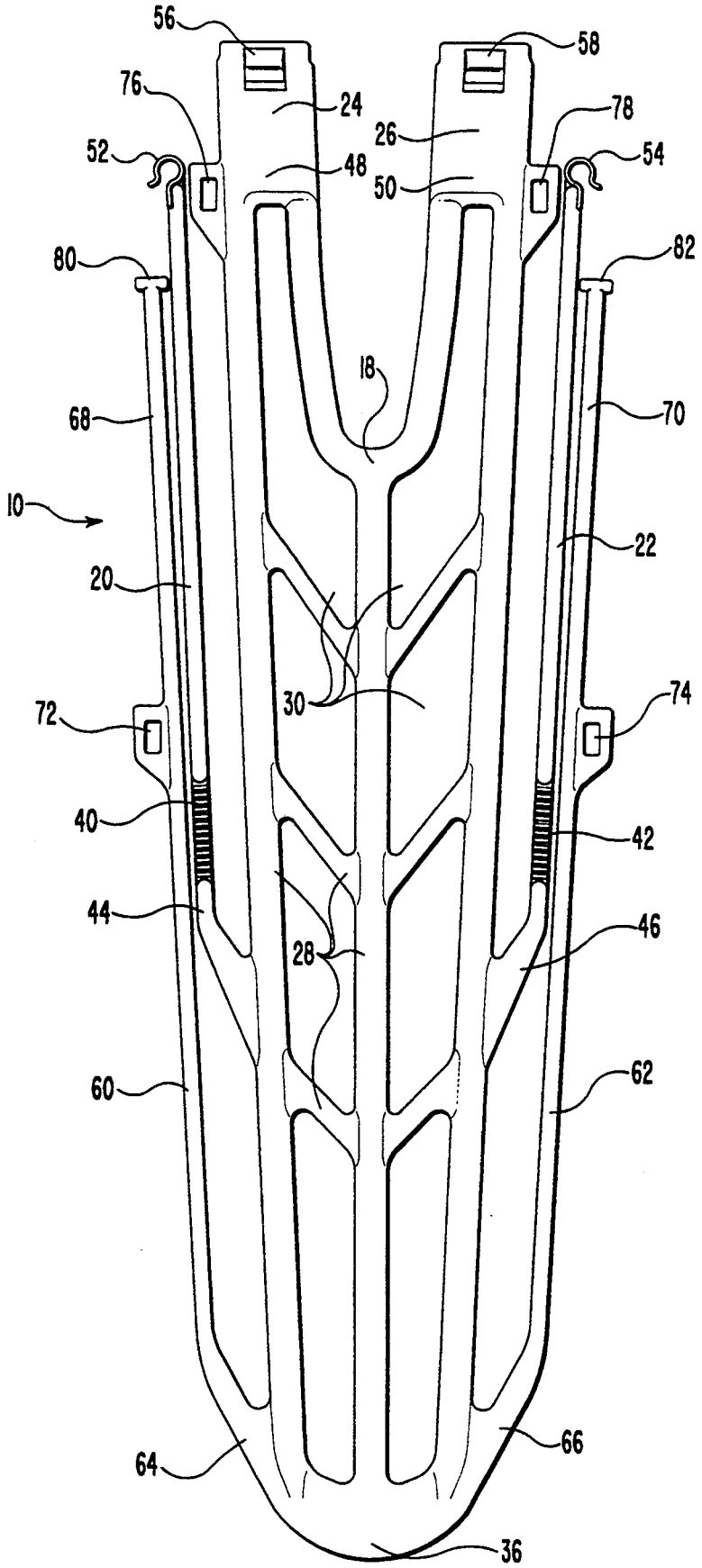
FIG. 2 is a top plan view of the apparatus shown in Figure 1, wherein the apparatus has been detached from the basketball hoop and placed in the passive mode.

As illustrated in FIG. 1, the apparatus 10 is attachable in its active mode to a basketball hoop 12 for returning a basketball 14 to a player (not shown) after each successful shot. In the active mode, the apparatus 10 has a ball return channel, indicated generally at 16, which directs the basketball 14 in a desired direction as indicated by Arrow A after the basketball 14 passes through the hoop 12. The basketball 14 shown is merely illustrative, as the apparatus 10 works with balls of a variety of sizes.

The apparatus 10 includes a runway 18 secured to a plurality of supports 20, 22, 24, and 26. The runway 18 preferably includes a mesh of interconnected bars 28. In cross-section, the bars 28 preferably have an inverted U or other conventional shape that provides both structural strength and a degree of flexibility.

Those of skill in the art will appreciate that a variety of other runway architectures also lie within the scope of the present invention. Thus, in alternative embodiments the runway 18 may or may not be perforated by openings 30. For instance, the runway 18 may be formed of a single flexible sheet, or of linked tiles, chains, or connected U-shaped sections. Although the runway 18 shown in FIG. 1 is arcuate along the ball channel 16, those of skill in the art will appreciate that inclined planes or other geometries may also be employed in conformance with the teachings of the present invention.

As shown in FIG. 1, the mesh openings 30 must be small enough to prevent passage of the basketball 14. Advantageously, the utilization of these or similar openings 30 permits the runway 18 to be constructed of less material, thereby reducing the materials cost and the shipping weight of the apparatus 10.

The runway 18 is suspended beneath the hoop 12 by the supports 20, 22, 24, and 26. The same pole 32 or other upright that holds the backboard 34 and hoop 12 above the court floor (not shown) also holds the runway 18 in mid-air. No additional poles or braces are needed.

Thus suspended, the runway 18 is well above the basketball court floor. When a preferred embodiment of the apparatus 10 is attached to a standard ten-foot high basketball hoop 12, the lower end 36 of the runway 18 is approximately eight feet above the court, and about eighteen inches (measured horizontally) from the leading edge 38 of the hoop 12. These measurements presume that the hoop 12 is oriented in the usual manner, that is, in a horizontal plane above the court floor.

In the presently preferred embodiment, two supports 24, 26 are rigidly integral with the runway 18, and two other supports 20, 22 are integrally secured to the runway 18 by flexible ribbed elbows 40, 42, respectively. Thus, each support 20, 22, 24, and 26 has a secured end 44, 46, 48, and 50, respectively, which is secured to the runway 18.

The other end of each support 20, 22, 24, and 26 has a hook 52, 54, 56, and 58, respectively. In the active mode, each hook 52, 54, 56, and 58 engages the basketball hoop 12 by hanging over the hoop 12 with an open portion of the hook 52, 54, 56, or 58 located on the underside of the hoop 12 as shown in FIG. 1. The hooks 52, 54, 56, and 58 are preferably formed of polypropylene plastic or a similar material having a "memory" so they remain engaged unless sufficient pressure is applied to open them or to pull them off the hoop 12. Manual pressure by a player suffices to open the hooks 52, 54, 56, and 58 and to disengage them from the hoop 12.

Those of skill in the art will appreciate that a wide variety of other hook shapes and materials may also be used. For instance, each hook may be in the form of an inverted U having sides several times longer than the vertically-measured cross-sectional diameter of the basketball hoop 12. The hooks may be formed of metal, leather, wood, or other materials. Moreover, those of skill in the art will appreciate that the apparatus may be releasably attached to the basketball hoop 12 through releasable attachment means other than hooks. Thus, the present invention also includes, but is not limited to, supports having snaps, bolts, or spring-loaded clamps.

The presently preferred embodiment of the apparatus 10 includes two struts 60, 62, one on each side of the runway 18. When the apparatus 10 is active, as illustrated in FIG. 1, the struts 60, 62 add structural stability and also help guide basketballs 14 down the runway 18. Each strut 60, 62 has a secured end 64, 66, respectively, which is preferably integral with the runway 18. Each strut 60, 62 also has an anchorable end 68, 70, respectively, which in the active mode is releasably anchored to a support 24, 26, respectively. In addition, each strut 60, 62 has an opening 72, 74, respectively, through which another support 20, 22, respectively, passes.

Those of skill in the art will appreciate, however, that the anchorable end 68 or 70 of either or both struts 60, 62 could also be attached to the basketball hoop 12, that more or fewer struts could be employed, and that either or both struts 60, 62 could be releasably anchored to the apparatus 10 at two ends 64 and 68, 66 and 70, respectively, rather than being integrally secured to the runway at one end 64, 66, respectively. Those of skill in the art will also appreciate that struts and supports may be releasably connected for stability in a variety of other ways, as openings, notches, dovetails, or other devices may be employed on the strut, on the support, or both. For instance, the struts may pass through openings in the supports, rather than vice versa. All such alternative embodiments lie within the scope of the present invention.

In the presently preferred embodiment, a portion of the anchorable end 68, 70 of each strut 60, 62 is T-shaped, as seen best in FIG. 2. Each support 24, 26 in which the strut 60, 62, respectively, is anchored in FIG. 1 has a rectangular opening 76, 78, respectively. In the active mode, each rectangular opening such as 76 is oriented with its longest axis substantially vertical, while the T-shaped anchorable end 68 of the corresponding strut 60 normally assumes a position in which the top crossbar of the T is horizontal. FIG. 2 best illustrates the shape of the crossbar 80, while FIG. 1 best illustrates the orientation of the crossbar (shown only in FIG. 2) in the active mode.

With reference to FIGS. 1 and 2, it will be appreciated that the anchorable end 68 and the rectangular opening 76 are relatively dimensioned such that the crossbar 80 will pass through the rectangular opening 76 if the crossbar 80 is rotated one quarter-turn, but will not pass through the vertically-oriented active mode rectangular opening 76 if the crossbar 80 is in its normal horizontal position. The crossbar 80 tends to resume the horizontal position after rotational pressure on the strut 60 is released because the polypropylene "remembers" and hence prefers that horizontal position. The discussion above applies equally to the second strut 62 and crossbar 82, and the corresponding support 26 and its rectangular opening 78.

The entire apparatus 10 preferably consists of one continuous piece of polypropylene plastic which has been formed by a blow-molding process. Polypropylene plastic has several advantages. The blow-molding process used to shape polypropylene permits rapid and economical mass production of the apparatus 10. The entire apparatus is light in weight, weighing approximately one and one-half pounds, thereby reducing shipping costs and aiding installation and removal of the apparatus 10 about the basketball hoop 12.

The polypropylene forming the runway 18 is sufficiently flexible to assume both the flexed configuration shown in Figure 1 and the flat state shown in FIG. 2.

The basketball 14 tends to roll down the flexed arcuate runway 18 shown in FIG. 1 rather than bouncing off the runway 18 because the arcuate shape changes the ball's direction more gradually than a simple inclined plane would.

In addition, the polypropylene apparatus is durable enough to absorb repeated impacts from basketballs 14. The apparatus 10 is also durable enough to withstand impact from players. The height and relatively small size of the apparatus 10 reduce the risk of inadvertent player contact with the apparatus 10. But the polypropylene is in any case flexible enough to substantially reduce the risk of injuring the player if such contact occurs.

Those of skill in the art will appreciate, however, that materials other than polypropylene may also be employed in embodiments of the present invention. For instance, high density polyethylene, other flexible plastic materials, various rubbers, or solid cores which have been coated with such materials may also be used. All such variations lie within the scope of the present invention.

The apparatus 10 may be selectively configured in either the active mode described above and illustrated in FIG. 1, or in the passive mode shown in FIG. 2. In the passive mode, the apparatus 10 is detached from the hoop (shown only in FIG. 1) and is substantially flat to permit easy shipping or storage. Because the polypropylene preferably used to construct the apparatus "remembers" and hence tends to assume the flexed active configuration illustrated in FIG. 1, the apparatus 10 will not necessarily lie completely flat when detached from the hoop. However, a gentle pressure applied by hand suffices to substantially flatten the apparatus 10. As used herein, the term "substantially flat" applies to an apparatus 10 which is somewhat bent or flexed but which flattens easily in response to such gentle pressures, as well as to a completely flat apparatus 10.

In operation, the apparatus 10 may be taken from the passive mode to the active mode, or vice versa. To configure the presently preferred embodiment of the apparatus 10 into its active mode from its passive mode, a first support 20 is passed through the opening 72 of a first strut 60, as illustrated in FIG. 1. Next, the crossbar 80 of the T-shaped anchorable end 68 of the first strut 60 is rotated one quarter-turn and passed through the rectangular opening 76 of a second support 24. The T-shaped anchorable end 68 of the strut 60 is then permitted to rotate back to its original horizontal position. In this position, the crossbar (80 in FIG. 2) of the anchorable end 68 does not fit through the vertically-oriented rectangular opening 76, so the strut 60 remains connected to the second support 24.

This procedure for releasably connecting a strut 60 to two supports 20, 24 is repeated with the second strut 62 on the opposite side of the runway 18 and the two remaining supports 22, 26. Anchoring the struts 60, 62 in this manner flexes the previously substantially flat runway 18 into an arc. The flexed runway 18, the supports 20, 22, 24, and 26, and the struts 60, 62 together form the ball return channel 16 that directs balls 14 back toward the player (not shown) after the apparatus 10 is attached to the basketball hoop 12.

To attach the apparatus 10 to the hoop 12, the hooks 52, 54, 56, and 58 on the supports 20, 22, 24, and 26 are hooked about the basketball hoop 12 so that the supports hold the apparatus 10 above the basketball court floor, with the upper end of the channel 16 directly beneath the hoop 12. Alternatively, some or all of the hooks 52, 54, 56, and 58 may be engaged before the runway 18 is flexed. In either case, the hooks 52, 54, 56, and 58 are placed on the hoop 12 in positions that orient the lower end 36 of the channel 16 at a desired angle relative to the backboard 34, so that the apparatus 10 returns the ball 14 in that direction after each successful shot. Although the angular orientation of the presently preferred embodiment must be changed manually, the present invention also includes embodiments in which the angular orientation is modified by a remote control carried by the player, as well as embodiments which automatically adjust the angular orientation in response to the player's movements.

To reach the passive mode from the active mode, the procedure just outlined is reversed. The apparatus 10 is detached from the basketball hoop 12 by opening the hooks 52, 54, 56, and 58 far enough to remove them from about the hoop 12. The hooks 52, 54, 56, and 58 are opened by an application of manual pressure to one end of the C-shape (best illustrated in FIG. 2) which forms each hook. The anchorable ends 68, 70 of the struts 60, 62 are freed from two of the supports 24, 26, and the other two supports 20, 22 are unthreaded from the openings 72, 74 in the struts 60, 62. Finally, the entire apparatus 10 is laid out substantially as shown in FIG. 2, and placed on a shelf, slid into a box, or otherwise stored. Assembling the apparatus 10 for use and disassembling it for storage thus requires little time and no hand or power tools.

If the apparatus 10 is in active mode on the basketball hoop 12 as shown in FIG. 1, basketballs 14 which pass through the hoop 12 will encounter the runway 18, roll down the channel 16 in a generally desirable direction as indicated by Arrow A, and return to the shooter's region. Unsuccessful shots, by contrast, are not returned by the apparatus 10. Thus, players are rewarded for successful shots and penalized by unsuccessful shots. Many conventional systems, by contrast, reward successful and unsuccessful shots equally by returning the ball after each.

In summary, the present invention provides a ball return apparatus and method that does not require one player to forego shooting by playing the role of ball retriever. After each successful shot, the apparatus directs the basketball back toward the player, according to the angular orientation given the apparatus by the player. Thus, much less potential shooting time is expended retrieving balls, particularly when one player was previously assigned solely to that task.

Unlike conventional approaches, the present apparatus does not substantially interfere with normal running play by blocking large sections of the basketball court with a web. The apparatus extends only about two feet below the hoop and about one and one-half feet outward from the hoop, and is suspended in mid-air above the court. No additional poles need be installed on the court. No webbing needs to be strung between the player and the hoop. Also, the apparatus does not interfere with side shots because the hoop is equally exposed whether the apparatus is attached or not.

Another advantage of the present invention is that one player may easily and quickly assemble and disassemble the apparatus. The apparatus is light in weight. No screwdrivers, hammers, or other tools are needed. Because there are no poles to install or sections of webbing to string up, the cooperating efforts of two players are not needed. One player can easily thread the supports through the strut openings, anchor the strut crossbars, and snap the hooks over the hoop. Disassembly is just as quick and easy. And once the apparatus is detached and flattened, it is relatively small and light, making it easy to store or ship.

It should be appreciated that the apparatus of the present invention is capable of embodiment in many forms, not all of which are illustrated and described in detail above. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by patent is:

1. A ball return apparatus which is releasably attachable to a basketball hoop mounted on a backboard, comprising a plurality of supports secured to a runway, said ball return apparatus formed of a single continuous piece of flexible material, and said ball return apparatus being capable of selective configuration between an active mode and a passive mode; in said active mode, said supports being attached to the basketball hoop and said supports and said runway forming a channel leading generally downward and away from the basketball hoop; in said passive mode, said ball return apparatus being detached from the basketball hoop and being disposed substantially flat.

2. The apparatus of claim 1, wherein each of said supports comprises a releasable attachment means for releasably attaching said support to the basketball hoop, said releasable attachment means tending to remain attached to the basketball hoop is once attached to the basket ball hoop.

3. The apparatus of claim 2, wherein said releasable attachment means comprises a C-shaped hook.

4. The apparatus of claim 3, wherein said hooks are configured to permit angular orientation of said ball return apparatus in a range of angles relative to the backboard if said ball return apparatus is in said active mode.

5. The apparatus of claim 1, further comprising a strut having a secured end and an anchorable end, said secured end being secured to said runway and said anchorable end being capable of releasable connection with at least one of said supports if said ball return apparatus is in said active mode for adding structural stability to said ball return apparatus in said active mode.

6. The apparatus of claim 5, wherein said strut has an opening through which at least one of said supports passes in releasable connection to said strut if said ball return apparatus is in said active mode.

7. The apparatus of claim 1, wherein said runway includes a mesh of interconnected bars disposed about openings.

8. The apparatus of claim 1, wherein said flexible material comprises polypropylene plastic.

9. A method for manipulating a ball return device having a passive mode in which it is substantially flat and also having an active mode in which it forms a channel attachable to a basketball hoop, the ball return device including a runway, a strut, a first support, and a second support, the strut having an opening, an end secured to the runway, and an anchorable end, the supports secured to the runway and attachable to the basketball hoop, the method comprising the steps of:

flexing the substantially flat ball return device to form a channel;

passing the first support through the opening in the strut;

releasably anchoring the anchorable end of the strut in the second support; and attaching the ball return device onto the basketball hoop.

10. The method of claim 9, comprising the additional steps of:

detaching the ball return device from the basketball hoop; and substantially flattening the ball return device.

11. A method for manipulating a ball return device having a passive mode in which it is substantially flat and also having an active mode in which it forms a channel attachable to a basketball hoop, the ball return device including a runway, a strut, a first support, and a second support, the strut having an opening, an end secured to the runway, and an anchorable end, the anchorable end of the strut being releasably anchored to the second support, the supports being secured to the runway and attached to the basketball hoop, the first support extending through the opening in the strut, and the ball return device forming a channel, the method comprising the steps of:

detaching the ball return device from the basketball hoop;

releasing the anchorable end of the strut from the second support;

unthreading the first support from the opening in the strut; and substantially flattening the ball return device.

* * * * *